US005371974A

United States Patent [19]

Lecerf et al.

[11] Patent Number: 5,371,974

[45] Date of Patent: Dec. 13, 1994

[54] AUTOMATIC MACHINE FOR GRINDING AND BEVELLING OPHTHALMIC GLASSES

[75] Inventors: Michel J. M. Lecerf, La Saussaye; Jean-Louis P. E. Simon, La Harengere; Raynald G. M. Longuet, Le Gros-Theil, all of France

[73] Assignee: Buchmann Optical Engineering, Ieper,

[21] Appl. No.: 136,954

[22] Filed: Oct. 14, 1993

[30] Foreign Application Priority Data

Nov. 10, 1992 [FR] France ..... 92 13519

[51] Int. Cl.[5] ..... B24B 49/00

[52] U.S. Cl. ..... 451/5; 451/240; 451/9

[58] Field of Search ..... 51/165.74, 165.75, 165 R, 51/165.71, 101 LG, 284 R, 284 E, 283 R, 326, 327, 105 LG

[56] References Cited

U.S. PATENT DOCUMENTS

| | | | |
|---|---|---|---|
| 4,300,317 | 11/1981 | Croft et al. | 51/101 LG |
| 4,596,091 | 6/1986 | Daboudet et al. | 51/165.75 |
| 4,829,715 | 5/1989 | Langlois et al. | 51/165.75 |
| 4,964,239 | 10/1990 | Gottschald et al. | 51/165.75 |
| 5,161,333 | 11/1992 | Lecerf et al. | 51/101 LG |
| 5,321,915 | 6/1994 | Lecerf et al. | 51/165.75 |

FOREIGN PATENT DOCUMENTS

| | | | |
|---|---|---|---|
| 1316564 | 12/1962 | France | 51/101 LG |
| 3537267 | 5/1986 | Germany | 51/101 LG |
| 3814670 | 11/1989 | Germany | 51/101 LG |

*Primary Examiner*—Maurina T. Rachuba
*Attorney, Agent, or Firm*—Martin Smolowitz

[57] ABSTRACT

The invention provides a machine for grinding and bevelling ophthalmic glasses of the type comprising a carriage (1) mounted to be movable in translation and in oscillation in a direction parallel with and perpendicular to a shaft (5) carrying at least one grinding wheel (4, 4A), and means for measuring the distance (L1) between the plane (PO) tangent to the pole (0) of the convex face of the glass (3) and the edge of the convex face, characterized in that the measuring means comprise means defining a reference surface (S) which is connected to move axially in translation with the grinding wheel, extends in a radial plane perpendicular to the axis of rotation of the grinding wheel and with which at least one point of the edge (A) of the convex face of the glass (3) is brought into contact by a movement in translation of the carriage (1), a sensor (18) for measuring the movements in translation of the carriage (1) relative to the grinding wheel (4) and means (12) for analyzing and processing signals from the sensor (18) for detecting the contact of the edge of the glass (3) with the reference surface (S) and deducing therefrom the distance (L1).

13 Claims, 2 Drawing Sheets

AUTOMATIC MACHINE FOR GRINDING AND BEVELLING OPHTHALMIC GLASSES

BACKGROUND OF THE INVENTION

The present invention relates to an automatic machine for grinding and bevelling glasses of spectacles.

Conventional machines for grinding and bevelling ophthalmic glasses comprise a U-shaped carriage which is slidably and pivotally mounted on a fixed horizontal shaft, a second horizontal shaft rotatively mounted in a perpendicular manner between the branches of the U-shaped carriage and consisting of two parts between which the glass to be machined is gripped, and a third rotatable horizontal shaft carrying at least one grinding wheel, and more particularly edge-trimming and bevelling grinding wheels.

When an optical glass blank having a thick edge surface has been cut to the shape of the frame, the edge surface of the glass has a cylindrical shape and a bevelling operation must be carried out by guiding the glass so as to form a V-sectioned bevel on the edge surface of the glass which must be located between the edges of its periphery, said projecting bevel being adapted to engage in the groove of the rim of the frame.

Machining such a bevel with manual control means is extremely difficult.

It has already been proposed to employ a "free bevel" system in which the edge surface of the blank is brought into a V-sectioned groove of a grinding wheel and the shaft carrying the glass is left free to move in translation during the grinding operation.

However, this system does not give a fully satisfactory result.

It is indeed desirable to construct a device which an permits obtaining a guided bevel on the edge surface of ophthalmic glass automatically and with high precision.

Document EP-A-0281,480 proposed for this purpose a machine for grinding and bevelling ophthalmic glasses of the aforementioned type which comprises a follower adapted to remain in contact with the edge surface of a shaped blank, in a position perpendicular to said edge surface, and adapted to measure the distance L1 from the edge of the front face of the glass relative to that of a flat glass in which L1=0.

This solution is not fully satisfactory, since the construction of the sensor, which is a mechanical sensor of complex and costly structure, is difficult to achieve. Further, the follower is of fragile construction and the contact of the latter with the edge surface of the glass results in a wear of the follower; moreover, the precision of the data obtained is too closely dependent on the construction of the follower.

It has already been proposed in document DE-A-3,842,601 to use a detecting fork each of the two teeth of which extends on one of the two sides of the blank grinding wheel and against which the front convex face and rear concave face of the glass to be ground abut.

The arrangement described in this document is particularly complex and costly and the two branches of the detecting fork, which must be resiliently deformable, are particularly fragile.

SUMMARY OF THE INVENTION

An object of the present invention is to provide a grinding machine in which the means for measuring the distance L1 between the plane tangent to the pole of the convex face of the glass and the edge of the face are particularly simple to use, cheap and strong.

The invention therefore provides a grinding machine of the aforementioned type, characterized in that the measuring means comprise means defining a reference surface which is connected to move in axial translation with the grinding wheel, extends in a radial plane perpendicular to the axis of rotation of the grinding wheel and with which at least one point of the convex face of the glass is brought into contact by translation of the carriage, a sensor for measuring the movements in translation of the carriage relative to the grinding wheel, and means for analyzing and processing signals delivered by the sensor for detecting the contact of the edge of the glass with said reference surface and deduce therefrom said distance L1.

The arrangement according to the invention is therefore particularly simple and the movement sensor is in fact a sensor of the movements in translation of the carriage of conventional design and is disposed in a region remote from the grinding region.

According to other features of the invention:

- the reference surface is an annular radial reference face of an element connected to move in translation with the grinding wheel;
- the grinding wheel comprises two adjacent grinding wheel sections, namely a roughing section and a finishing section, and the annular reference face is provided in the connection zone between the two sections of the grinding wheel;
- the annular reference surface is defined by the radial face of a shoulder on the grinding wheel;
- the reference surface is defined by the annular peripheral portion of one of the two opposite faces of a washer which bears against a radial face of the grinding wheel;
- the washer is provided between the adjacent radial faces of the two grinding wheel sections;
- the washer is connected to rotate with the grinding wheel;
- the washer is freely rotatively mounted on the driving shaft of the grinding wheel;
- the machine comprises a sensor for determining the angular position of the glass about an axis of a shaft of the carriage which carries the glass so as to measure said distance L1 for at least one given point of the edge of the convex face of the glass;
- said distance L1 is measured in succession for four measuring points angularly spaced substantially 90° apart.

BRIEF DESCRIPTION OF THE DRAWINGS

Further features and advantages of the invention will be apparent from the following detailed description with reference to the accompanying drawings in which.

DESCRIPTION OF THE PREFERRED EMBODIMENT

Figure 1:
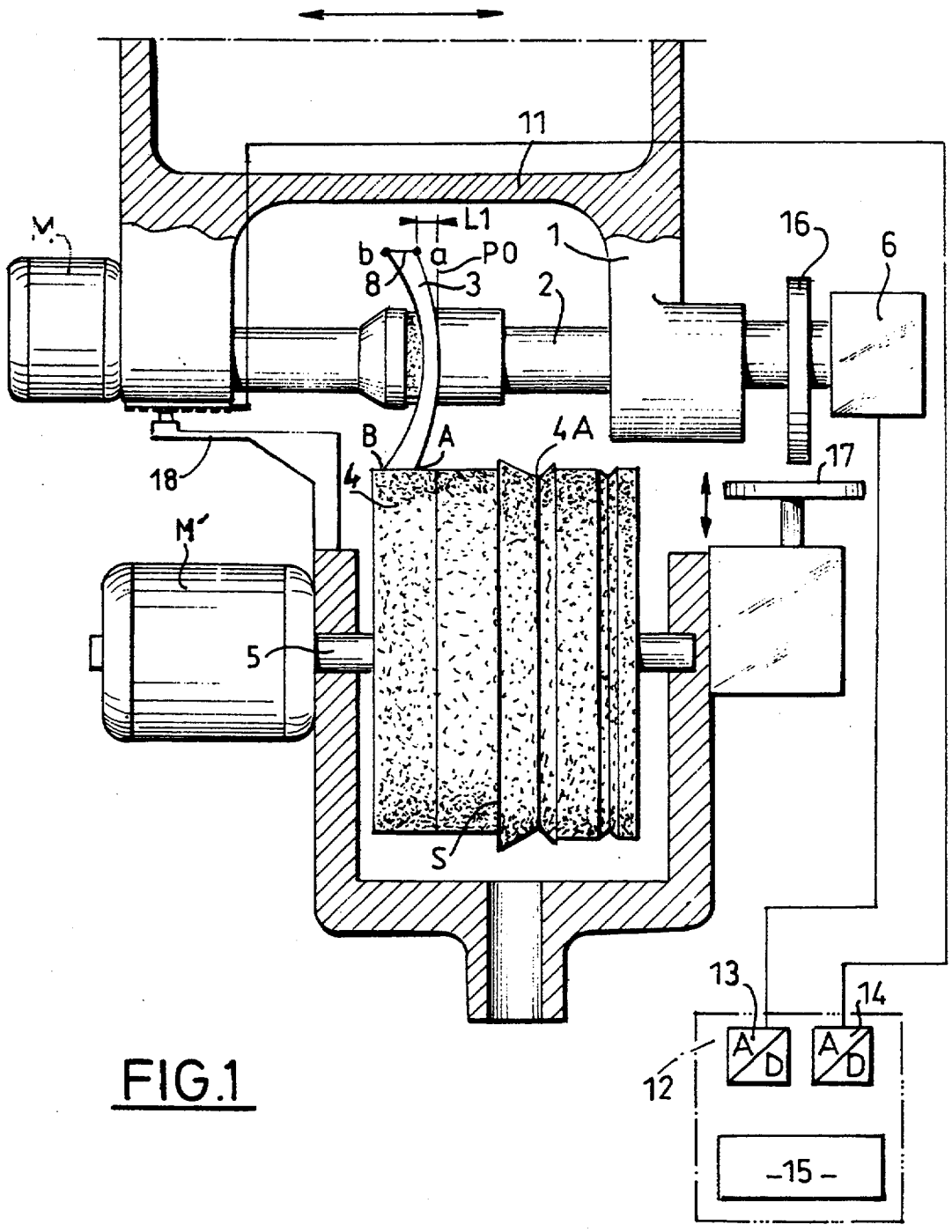
FIG. 1 is a partial diagrammatic view of a grinding and bevelling machine of conventional type, to which the invention is applied.
Figure 2:
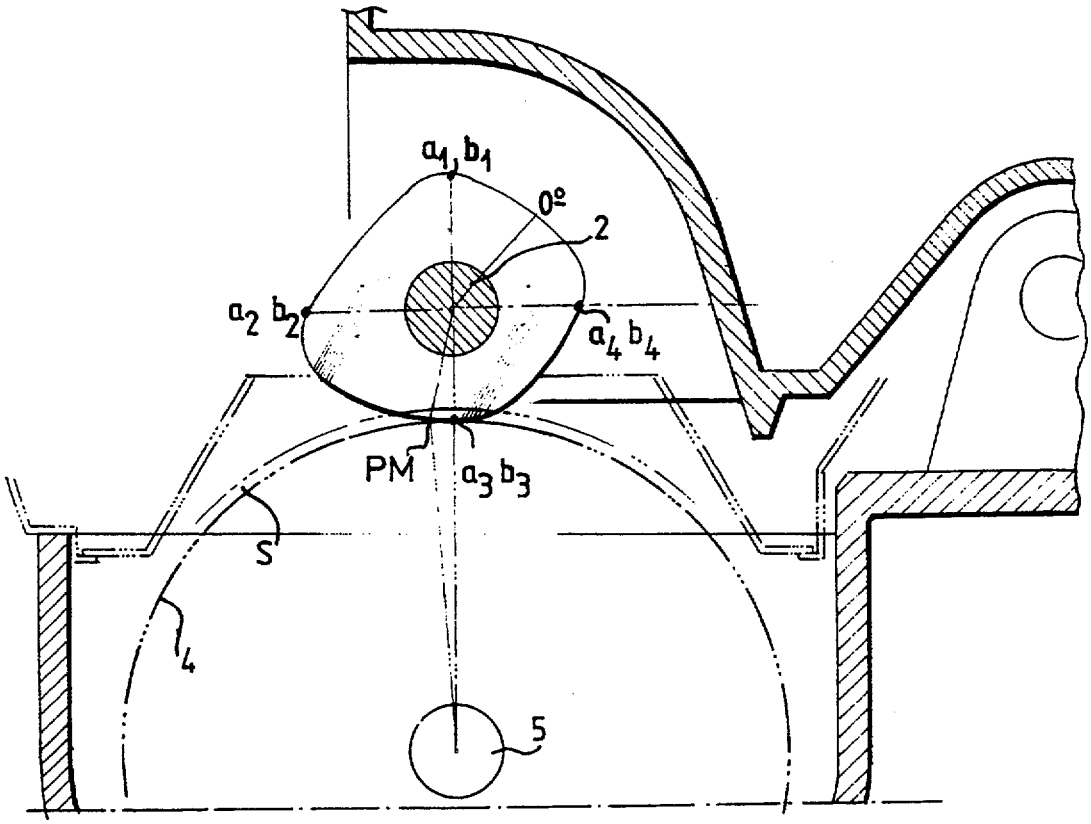
FIG. 2 is an end elevational view of the machine shown in FIG. 1.

With reference to FIGS. 1 and 2, a conventional grinding and bevelling machine comprises a U-shaped carriage 1 which is pivotally mounted on a horizontal shaft (not shown) and between the branches of which is rotatively mounted, and driven in rotation by a motor M, a second horizontal shaft 2 in two parts between which is gripped a blank 3 of an ophthalmic glass the contour of which is ground by a grinding wheel 4 which is rotatively mounted and driven in rotation by a third horizontal shaft 5 driven in rotation by a motor M'.

In the known manner, the machine also includes means 6, such as a sensor having a code wheel, which gives at each instant the angular position of the shaft 2, and therefore the angular position of the glass 3, about the axis of rotation of the shaft 2.

According to the invention, the machine comprises means for measuring the distance L1 between a reference plane PO, which is tangent to the pole O of the convex spherical face of the glass, and the edge A of the convex face of the glass.

These measuring means comprise a sensor 18, diagrammatically represented in FIG. 1 in the form of an electric rheostatic potentiometer, which permits measuring the movements in translation of the carriage 1, and consequently of the glass 3, relative to the frame of the machine and therefore relative to the grinding wheel.

The measuring means further comprise a reference surface S which, in the embodiment illustrated in the Figures, is defined by the annular face of a radial shoulder on the grinding wheel which separates the roughing section 4 from the finishing section 4A of the grinding wheel which extend axially on opposite sides of the surface S, respectively to the left and to the right as viewed in FIG. 1.

In a known design, the grinding wheel is most commonly constructed in the form of two adjacent and distinct grinding wheel sections which are mounted on a common driving shaft 5.

The radial dimension of the annular reference surface, which results from the difference between the diameters of the two adjacent faces of the two sections of the grinding wheel, is small and for example on the order of 1 to 2 mm.

The machine further comprises electronic means for analyzing and processing signals, diagrammatically illustrated in the form of a block 12 which comprises in particular analog-to-digital converters 13 and 14 and calculating means 15 which form from data delivered by the sensors 6 and 18, as will be explained hereinafter, signals controlling the movements of the carriage 1 which are employed when bevelling the edge surface on the finishing section 4A of the grinding wheel.

In the case of numerically or digitally controlled grinding machines which do not employ a shape template and in which this template is replaced by a circular disc concentric with the shaft 2, these machines operate from a register of memorized shapes which permits the automatic control of the movement key 17.

Figure 3:
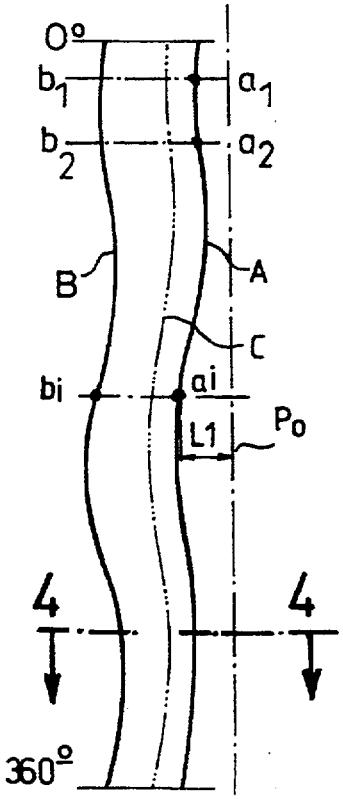
FIG. 3 is a developed view of the edge surface of an optical glass.
Figure 4:
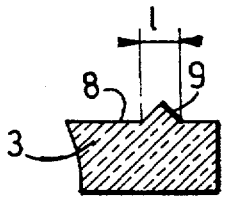
FIG. 4 is a sectional view, taken on line 4—4 of FIG. 3, illustrating the shape of the bevel on the edge surface of the glass.

With reference to FIGS. 3 and 4, it can be seen that the edge surface of the glass may be represented in the form of two substantially parallel lateral edges A and B constituted by series of points a1–b1, a2–b2, ai–bi, etc. corresponding to different angular positions of the glass. An intermediate line C represents the trace of the free edge of the bevel 9 in relief formed on the edge surface 8 of the glass.

When it is desired to measure the distance L1, the control means of the machine cause the shaft 2 to stop rotating, then the carriage I to move in translation, from the left toward the right as viewed in FIG. 1, so as to cause the peripheral edge of tile convex face of the glass to bear against the annular reference surface S.

In the course of this movement in translation, the movement sensor 18 transmits signals to the unit 12 which, on one hand, deduces therefrom, when the movement in translation ceases, that the peripheral edge A of the convex face is bearing against the radial shoulder or surface S and, on the other hand, calculates the distance L1.

The measuring operation may be repeated for example at four points a1, a2, a3 and a4 of the edge of the front face of the glass which are for example angularly evenly spaced 90° apart, as illustrated in FIG. 2, and substantially correspond to the four corners of the glass.

The machine according to the invention therefore employs a process for measuring the distance L1 which merely requires putting the convex face of the glass in contact with the reference surface S.

Inasmuch as the bevel 9 has a small width "l", usually less than 3 mm, it is certain that it will always be located within the thickness ai, bi.

As can be seen from FIG. 2, and owing to the design of the invention, the contact point of the peripheral edge of the convex front face is located on the same radius as the grinding point PM and it is therefore unnecessary to resort to calculated corrections as is required in some devices of the prior art.

When the radial shoulder constituting the reference surface S is constituted by a shoulder on the grinding wheel itself, and bearing in mind that the grinding wheel rotates at high speed, it is desirable to cover this shoulder with a non-abrasive material.

However, in the case where the surface S itself is abrasive, a very slight marking is produced on the edge of the convex face of the glass, but this marking occurs in an extra thick region which will disappear in the finishing operation forming the bevel.

Subsequent to the measuring operation, the calculating means 12 compare the position of the measured points ai with the theoretical position of the programmed and memorized bevel. If there is no concordance, the calculating means 12 modify the parameters of the control of the grinding machine so as to correct this lack of concordance.

This correction is carried out by causing the theoretical sphere to rotate in space. If after this correction the concordance with the programmed bevel is not attained, a different theoretical sphere is employed.

It will be observed that the operation for measuring the distance L1 requires neither stopping the rotation of the grinding wheel nor temporarily stopping the spraying.

In an alternative embodiment, the reference surface S may be defined by one of the two opposite radial faces of a reference washer interposed between the two sections of the grinding wheel and mounted on the driving shaft 5 of the latter.

The washer may be driven in rotation with the grinding wheel or comprise means, such as for example a rolling bearing, so that it may be freely rotatively mounted on the shaft 5 so as to avoid the phenomena marking the edge of the convex outer face of the glass 3.

If the washer is driven in rotation with the grinding wheel, it is also possible to cover the radial reference surface S with a material having a very low coefficient of friction.

The measurement may be carried out in any number of points by stopping or not stopping the rotation of the glass.

What is claimed is:

1. Machine for grinding and bevelling an ophthalmic glass comprising in combination: a rotary shaft, a grinding wheel carried by said shaft and rotatable about an axis, a carriage carrying said glass and mounted to be movable in translation and in oscillation in directions respectively parallel with and perpendicular to said shaft, and means for measuring a distance L1 between a plane tangent to the pole of a convex face of said glass and the edge of said convex face, said measuring means comprising means defining a reference surface which is connected to move axially in translation with said grinding wheel and extends in a radial plane perpendicular to said axis of rotation, whereby said movement of translation of said carriage brings at least one point of said edge of said convex face of said glass in contact with said reference surface, a sensor for measuring movements in translation of said carriage relative to said grinding wheel, and means for analyzing and processing signals delivered by said sensor for detecting said contact of said at least one edge of said convex face of said glass with said reference surface and deducing therefrom said distance L1.

2. Machine according to claim 1, wherein said reference surface is an annular radial reference surface and said means defining said reference surface is an element connected to move in axial translation with said grinding wheel.

3. Machine according to claim 2, wherein said grinding wheel comprises two adjacent grinding wheel sections, namely a roughing section and a finishing section, and said element defining said annular reference surface is provided in a connection zone between said two sections.

4. Machine according to claim 3, wherein said annular reference surface is defined by a radial surface of a shoulder on said grinding wheel.

5. Machine according to claim 2, comprising a washer which bears against a radial face of said grinding wheel, said reference surface being defined by an annular peripheral portion of one of two opposite faces of said washer.

6. Machine according to claim 5, wherein said grinding wheel comprises two adjacent grinding wheel sections, namely a roughing section and a finishing section, and said annular reference surface is provided in a connection zone between said two sections, said washer being provided between adjacent radial faces of said two grinding wheel sections.

7. Machine according to claim 5, wherein said washer is connected to rotate with said grinding wheel.

8. Machine according to claim 6, wherein said washer is connected to rotate with said grinding wheel.

9. Machine according to claim 5, wherein said washer is freely rotatively mounted on said driving shaft of said grinding wheel.

10. Machine according to claim 6, wherein said washer is freely rotatively mounted on said driving shaft of said grinding wheel.

11. Machine according to claim 1, comprising a second shaft for rotating said glass relative to said carriage about a second axis, and a sensor for determining the angular position of said glass about said second axis for the purpose of measuring said distance L1 for a given angular position of said glass and in particular for said at least one given point of said edge of said convex face of said glass.

12. Machine according to claim 11, wherein said distance L1 for a given angular position of said glass is measured in succession for four measuring points spaced angularly substantially 90° apart.

13. Machine according to claim 11, wherein said measuring point is located on the same radius as a grinding point between said glass and said grinding wheel.

* * * * *